United States Patent [19]

Petrovich

[11] 4,211,642

[45] Jul. 8, 1980

[54] BENEFICIATION OF COAL AND METALLIC AND NON-METALLIC ORES BY FROTH FLOTATION PROCESS USING POLYHYDROXY ALKYL XANTHATE DEPRESSANTS

[76] Inventor: Vojislav Petrovich, 1935 W. Schiller St., Chicago, Ill. 60622

[21] Appl. No.: 1,945

[22] Filed: Jan. 5, 1979

[51] Int. Cl.[2] ..... B03D 1/06

[52] U.S. Cl. ..... 209/167

[58] Field of Search ..... 209/166, 167; 252/61; 44/1 R–1 S

[56] References Cited

U.S. PATENT DOCUMENTS

| | | | |
|---|---|---|---|
| 1,970,508 | 8/1934 | Christmann | 209/166 |
| 2,024,925 | 12/1935 | Hirschkind | 209/166 X |
| 2,319,394 | 5/1943 | Erickson | 209/166 X |
| 2,321,593 | 6/1943 | Gresham | 209/166 X |
| 2,629,493 | 2/1953 | Brown | 209/166 |
| 2,629,494 | 2/1953 | Brown | 209/166 |
| 3,770,213 | 11/1973 | Lynn | 209/166 |
| 3,827,557 | 8/1974 | Fischer | 209/167 |

FOREIGN PATENT DOCUMENTS

| | | | |
|---|---|---|---|
| 49-55502 | 5/1974 | Japan | 209/167 |
| 272301 | 6/1927 | United Kingdom | 209/166 |

*Primary Examiner*—Robert Halper

[57] ABSTRACT

Beneficiation of coals, metallic, and non-metallic ores by froth flotation process using polyhydroxy alkyl xanthate depressants for pyrite in coals, or in metallic and non-metallic ores to obtain pyrite sulfur free coal, as well as pyrite free metallic or non-metallic minerals by depressing pyrite and marcasite as the waste material of coal or ore, comprises; adding to a water suspension of finely divided coal or ore of a polyhydroxy alkyl xanthate to depress pyrite and certain organic sulfur compounds in the presence of an adequate collector for recovering pyrite sulfur free coal, or pyrite and marcasite free mineral concentrates.

2 Claims, No Drawings

BENEFICIATION OF COAL AND METALLIC AND NON-METALLIC ORES BY FROTH FLOTATION PROCESS USING POLYHYDROXY ALKYL XANTHATE DEPRESSANTS

The present invention relates to froth flotation of coal and minerals from their ores, and more particularly to the recovery of coal free of iron sulfides such as pyrite and marcasite, and to the recovery of such metallic and non-metallic minerals which are embedded intimately in a matrix of pyrite, but by itself are nonresponsive to xanthates.

The object of this invention is to provide an improved froth flotation process in which, through the application of polyhydroxy alkyl xanthates unwanted iron sulfides material such as pyrite and marcasite and certain organic sulfur compounds responsive to xanthates are depressed by deactivating the same to the used collectors, and thereby largely eliminating iron sulfides such as pyrite and marcasite from coal concentrate inhibiting the pyrite and marcasite to float in the froth of coal, or the desired mineral, despite the responsivness of iron sulfide to the used collector for the desired mineral to be recovered, thus improving concentrated coal, as well as the desired metallic or non-metallic mineral concentrates by froth flotation.

Froth flotation is roughly based on the fact that the surface of coal as well as of a given mineral to be recovered may be rendered, by the action of so-called collectors, more or less water repellent, i.e., aerophil, and a coal-, i.e., mineral- air complex, the specific gravity of which is lower than that of the pulp of coal or mineral slurry, is thus formed with the air bubbles introduced into the pulp of coal or mineral slurry. The binding of the collector to the coal or mineral surface by forces of chemoadsorption, physicaladsorption, etc., is due to electrostatic forces in both of the collector itself and the said surface.

It is well known that the alkyl xanthates used in froth flotation practice are sulfide collectors. Thus, the objective of the present invention is to introduce in the flotation circuit polyhydroxy alkyl xanthates, thus accomplishing a highly wettable and hydrophilic surface of pyrite, marcasite, and certain grains of coal composed of organic sulfur of sulfidic character, which hydrophilicity prevents pyrite, marcasite and grains of organic sulfur compounds of coal to float in the froth, and thus contaminate the floated coal, leaving pyrite, marcasite and said organic sulfur compounds in tailing.

It is therefore obvious, that in the flotation of coal as well as of ores, chemical and physical control is directed firstly, toward increasing the floatability of pure coal or the wanted minerals and secondly, toward minimizing any flotation tendency exhibited by the at in the flotation of coal as well as of ores, chemical and physical control is directed firstly, toward increasing the floatability of pure coal or the wanted minerals and secondly, toward minimizing any flotation tendency exhibited by the unwanted gangue minerals in the admixture, i.e., the pyrite, marcasite, and organic sulfur compounds.

The present invention has the second of these objectives in view and, for the accomplishment of the same, it proposes to add to the flotation pulp of coal or mineral slurry relatively small amounts of certain polyhydroxy alkyl xanthates, which will be described presently, that react with the pyrite, marcasite, and organic sulfur compounds as gangue material, thus preventing the flotation of said gangue material.

Broadly, the invention embraces the addition to a flotation pulp of coal or mineral slurry polyhydroxy alkyl xanthates able to form very stable, water insoluble but hydrophilic compound with pyrite, marcasite, and certain organic sulfur compounds, which being adsorbed on the said gangue particles prevent or inhibit the same particles from exerting an activating, i.e., promoting effect with used collectors, thus being inhibited from concentrating in the flotation froth.

As stated above, pyrite, marcasite, certain organic sulfur compounds adsorb polyhydroxy alkyl xanthates of this invention, thereby rendering themselves harmless to the froth flotation of pure coal or the desired mineral. The polyhydroxy alkyl xanthates will tie up the pyrite, marcasite, and organic sulfur compounds, eliminating thus all of them as active factors in the process of froth flotation. Pyrite, marcasite, and organic sulfur compounds will exhibit no tendency to contaminate the coal concentrate, or the metallic or non-metallic concentrates.

The invention is based upon the principle that pyrite, marcasite, and organic sulfur compounds of coal may caused to form much more stable undissociable, hydrophilic compounds with polyhydroxy alkyl xanthates, which will be set forth hereinafter, which are added to the pulp of coal slurry or to with pyrite contaminated metallic or non-metallic ores, to depress the said pyrite, marcasite and organic sulfur compounds in their respective mineral slurries.

The polyhydroxy alkyl xanthate depressants which are the specific subject of the present invention, have the following structural characteristics:

| | |
|---|---|
| **TETRITOL XANTHATES** | |
| Potassium erythrytol xanthate | $HOCH_2(CHOH)_2CH_2CCSSK$ |
| Potassium pentaerythrytol xanthate | $(CH_2OH)_3CCH_2OCSSK$ |
| **PENTITOL XANTHATES** | |
| Potassium arabitol xanthate | $HOCH_2(CHOH)_3CH_2OCSSK$ |
| Potassium xylitol xanthate | " |
| Potassium adonitol xanthate | " |
| Potassium rhamnitol xanthate | " |
| **HEXITOL XANTHATES** | |
| Potassium mannitol xanthate | $HCCH_2(CHOH)_4CH_2OCSSK$ |
| Potassium sorbitol xanthate | " |
| Potassium dulcitol xanthate | " |
| **HEPTITOL XANTHATES** | |
| Potassium glucoheptitol xanthate | $HOCH_2(CHOH)_5CH_2OCSSK$ |
| **OCTITOL XANTHATES** | |
| Potassium glucooctitol xanthate | $HOCH_2(CHOH)_6CH_2OCSSK$ |

-continued

| | |
|---|---|
| NONITOL XANTHATES | |
| Potassium gluconitol xanthate | $HOCH_2(CHOH)_7CH_2OCSSK$ |
| PENTOSE XANTHATES | |
| Potassium arabinose xanthate | $HOHCH_2(CHOH)_2(CHO)CH . OCSSK$ |
| Potassium xylose xanthate | " |
| HEXOSE XANTHATES | |
| Potassium glucose xanthate | $HOCH_2(CHOH)_3(CHO)CH . OCSSK$ |
| Potassium fructose xanthate | " |

Thus the generic formula of alkylol xanthates is: $HOCH_2(CHOH)_nCH_2OCSSK$ wherein n is 2 to 7;
The generic formula of pentose and hexose xanthates is: $HOCH_2(CHOH)_m(CHO)CH_2OCSSK$ wherein n is 2 to 3;

The Examples of investigation of pyrite responsivness to polyhydroxy alkyl xanthates are accomplished with fatty acids to which pyrite is responsive to some extent, thus a pyritic schist, and a dereagentized commercial pyrite were investigated.

The Examples of investigation of coal with a substantial amount of pyrite and organic compounded sulfur were investigated. The coal was floated with a wood tar oil to which it responded well.

The increments of coal were only 200 g for each investigation of the depressing extent of pyrite. The increments of commercial pyrite and pyritic schist were 400 g.

Table 1

| Example material treated | Collector kg/t | Depressor kg/t | Recovery % of sulfur concentrate | tailing |
|---|---|---|---|---|
| 1. Pyritic shist | Fatty acid 0.5 kg/t | Potassium pentaerythritol xanthate 0.05 kg/t | non | all the pyrite |
| 2. Pyritic shist | same | Potassium mannitol xanthate 0.05 kg/t | non | all the pyrite |
| 3. Dereagentized commercial pyrite | same | Potassium arabitol xanthate 0.10 kg/t | non | all the pyrite |
| 4. Dereagentized commercial pyrite | same | Potassium glucose xanthate 0.10 kg/t | non | all the pyrite |

Table 2

| Example coal treated | Collector kg/t | Depressor kg/t | Feed sulfur pyritic | total | Recovery % sulfur conc. total | tailing total |
|---|---|---|---|---|---|---|
| I. Illinois coalbed No6 Knox county | wood tar oil 0.15 kg/t | Potassium mannitol xanthate 0.02 kg/t | 5.7 | 7.7 | 2.1 | 5.6 |
| 2. Illinois coalbed No2 Fulton county | same | Potassium glucose xanthate 0.02 kg/t | 4.1 | 5.5 | 1.5 | 4.0 |
| 3. Indiana coalbed No III Greene county | same | Potassium arabinose xanthate 0.02 kg/t | 4.5 | 7.1 | 2.6 | 4.5 |
| 4. Iowa Lower Ford coal Marion county | same | Potassium heptitol xanthate 0.04 kg/t | 10.3 | 12.1 | 2.3 | 9.8 |
| 5. Iowa coalbed-uncorrelated Marion county | same | Potassium glucose xanthate 0.03 kg/t | 7.4 | 10.4 | 3.2 | 7.1 |

Table 1, shows that polyhydroxy alkyl xanthates are excellent depressors for pyrite. The inactivating of pyrite was genuine. A true froth was not observed.

Table 2, shows that polyhydroxy alkyl xanthates depress the liberated pyrite or marcasite from coal. The investigations have shown that tailings are not pure pyrite, a certain amount of coal is also depressed, besides of other mineral waste material of coal. The heavy liquid differential settlings were pyrite and mineral waste, the float was coal, which showed always an amount of sulfur. It was not investigated if the depressed coal contains organic sulfur, because of very small amount of the same, but it is presumptive that it is.

From the above it is obvious that high sulfur coal containing a high percentage of pyrite sulfur may be beneficiated by froth flotation using polyhydroxy alkyl xanthates as depressor for pyrite; thus, many of such coals could be upgraded to meet the current Environmental Protection Agency standard of 1.2 pounds of $SO_2$ emission per millin Btu when beneficiated by froth flotation using polyhydroxy alkyl xanthates as depressant for pyrite and marcasite in coal. Air pollution from combustion of fossil fuels has long been recognixed as a problem by the Environmental Protection Agency, because of which the Quality Act of 1963 initiated the effort to preserve the Nation's air quality. Generally, significant sulfur reduction is achieved if the coals are crushed and sized to finer sizes amenable to froth flotation by which method all the non-responsive material representing waste as well as the non-responsive material to applied collectors are potentially removed by this feasible method, by which also the lowest cost may be achieved.

Therefore, the use, accordiing to the present invention, of polyhydroxy alkyl xanthates for accomplishing the purpose of pyrite depression through the application of the same in froth flotation of high sulfur-coals, i.e., high pyritic coals constitutes a marked advance in the art of froth flotation, and is highly advantageous in improving the quality of burning coals.

What is claimed is:

1. In the concentration by froth flotation of coals with high sulfur content especially of iron sulfides such as pyrite and marcasite which are removable, which includes the subjecting of such coals when finely ground to substantially liberate grains of pyrite and marcasite, to froth flotation process in the presence of any suitable and adequate collector and frother for coal, for the recovery of coal values, and in the presence of polyhydroxy alkyl xanthate wetting and depressing agent for pyrite and marcasite, the step of adding to a pulp of coal slurry an amount of the order of 0.01 to 0.05 kg per metric ton of a non-collecting polyhydroxy alkyl xanthate, of which hydroxyl groups of said polyhydroxy alkyl xanthate contain from 3 to 8 and having the following general formula $$HOCH_2(CHOH)_nCH_2OCSSK$$

wherein n is an integer from 2 to 7; said polyhydroxy alkyl xanthates, react with pyrite and marcasite of the pulp of coal slurry to yield a water soluble or insoluble hydrophilic coating, depressing the pyrite and the marcasite of coal.

2. In the concentration of metallic and non-metallic minerals by froth flotation with a high content of pyrite and the like iron sulfides, which includes the subjecting of such ores when finely ground and sized to substantially liberate particles of pyrite, to froth flotation process in the presence of any suitable and adequate collector and frother for desired metallic and non-metallic mineral for the recovery of the same, and in the presence of a polyhydroxy alkyl xanthate wetting and depressing agent for pyrite, the step of adding to a pulp of mineral slurry an amount of the order of 0.01 to 0.10 kg per metric ton of a non-collecting polyhydroxy alkyl xanthate, of which hydroxyl groups of said polyhydroxy alkyl xanthates contain from 3 to 4, and having the following general formula:

$$HOCH_2(CHOH)_mCH(CHO)OCSSK$$

wherein m is an integer from 2 to 3; said polyhydroxy alkyl xanthates, react with pyrite and said iron sulfides of the pulp of mineral slurry to yield a water soluble or insoluble hydrophilic coating depressing the pyrite and said iron sulfides, said polyhydroxy alkyl xanthates being selected from the group consisting of potassium pentose, and potassium hexose xanthates, such as potassium arabinose xanthate, potassium xylose xanthate, potassium glucose xanthate, potassium fructose xanthate.

* * * * *